US010757989B2

(12) United States Patent
Nam

(10) Patent No.: US 10,757,989 B2
(45) Date of Patent: Sep. 1, 2020

(54) FABRIC WITH EMBEDDED INFORMATION BEACON

(71) Applicant: Kiyeon Nam, Bayside, NY (US)

(72) Inventor: Kiyeon Nam, Bayside, NY (US)

( * ) Notice: Subject to any disclaimer, the term of this patent is extended or adjusted under 35 U.S.C. 154(b) by 179 days.

(21) Appl. No.: 15/625,717

(22) Filed: Jun. 16, 2017

(65) Prior Publication Data

US 2018/0153234 A1 Jun. 7, 2018
US 2019/0082753 A9 Mar. 21, 2019

Related U.S. Application Data

(63) Continuation-in-part of application No. 14/843,924, filed on Sep. 2, 2015, now abandoned.

(51) Int. Cl.

| | |
|---|---|
| ***D04B 1/24*** | (2006.01) |
| ***A41D 15/00*** | (2006.01) |
| ***A41D 27/08*** | (2006.01) |
| ***A41D 19/01*** | (2006.01) |
| ***D04B 15/36*** | (2006.01) |
| ***A41D 27/24*** | (2006.01) |

(Continued)

(52) U.S. Cl.

CPC ..... *A41D 15/00* (2013.01); *A41D 3/08* (2013.01); *A41D 15/04* (2013.01); *A41D 19/01* (2013.01); *A41D 23/00* (2013.01); *A41D 27/08* (2013.01); *A41D 27/10* (2013.01); *A41D 27/24* (2013.01); *D04B 7/28* (2013.01); *D04B 7/34* (2013.01); *D04B 15/10* (2013.01); *D04B 15/36* (2013.01); *A41D 2500/10* (2013.01); *D04B 1/24* (2013.01)

(58) Field of Classification Search
None
See application file for complete search history.

(56) References Cited

U.S. PATENT DOCUMENTS 4,839,777 A * 6/1989 Janko ..... A41D 27/085 362/103
10,217,042 B2 * 2/2019 DeBates ..... G06K 19/077
(Continued)

FOREIGN PATENT DOCUMENTS

| | | | |
|---|---|---|---|
| CN | 103129038 | A | 6/2013 |
| CN | 203015853 | U | 6/2013 |
| CN | 203262492 | U | 11/2013 |

*Primary Examiner* — Steven Lim
*Assistant Examiner* — Muhammad Adnan
(74) *Attorney, Agent, or Firm* — Stephen E. Feldman; Feldman Law Group, P.C.

(57) ABSTRACT

A composite fabric is disclosed in which an information beacon is embedded within the composite fabric to assist with loss prevention, anti-counterfeiting, locating lost individuals or the like. In embodiments, layers of fabric may be joined using adhesive, stitching, quilted stitching, riveting, or other means to securely house an information beacon. In embodiments of the invention, an information beacon may be encased in a housing that provides resistance to environmental factors such as moisture and temperature and allows the fabric to be washed in a conventional laundry cycle. In embodiment, Bluetooth Low Energy device that utilizes a smartphone and mobile application software to provide the location of the beacon. In alternate embodiments, RFID or other technology may be used. The composite fabric of the present invention has myriad uses and may be used to fabricate articles such as clothing, handbags, wallets, shoes, and so forth.

20 Claims, 11 Drawing Sheets

(51) Int. Cl.

| | |
|---|---|
| ***D04B 7/34*** | (2006.01) |
| ***D04B 7/28*** | (2006.01) |
| ***A41D 27/10*** | (2006.01) |
| ***A41D 23/00*** | (2006.01) |
| ***A41D 3/08*** | (2006.01) |
| ***D04B 15/10*** | (2006.01) |
| ***A41D 15/04*** | (2006.01) |

(56) References Cited

U.S. PATENT DOCUMENTS 10,453,322 B2 * 10/2019 Kaindl ..... G08B 6/00
2005/0064286 A1 * 3/2005 Kozu ..... H01M 2/1066 429/180
2005/0114236 A1 * 5/2005 Hammell ..... G06Q 10/08 705/28
2006/0162156 A1 * 7/2006 Reed ..... B29C 45/14647 29/841
2006/0180647 A1 * 8/2006 Hansen ..... B60S 3/00 235/375
2006/0290514 A1 * 12/2006 Sakama ..... G06K 19/027 340/572.7
2008/0133659 A1 * 6/2008 Aldrey ..... G06Q 10/08 709/204
2010/0321161 A1 * 12/2010 Isabell ..... D06H 1/00 340/10.1
2012/0123960 A1 * 5/2012 Vock ..... A43B 3/00 705/330
2012/0273577 A1 * 11/2012 Kim ..... G06K 19/07722 235/488
2012/0298758 A1 * 11/2012 Vishwanath ..... G06K 19/0773 235/492
2013/0342343 A1 * 12/2013 Harring ..... G08B 21/18 340/521
2014/0070957 A1 * 3/2014 Longinotti-Buitoni ..... A61B 5/6804 340/870.01
2015/0024224 A1 * 1/2015 Arita ..... H01L 23/293 428/474.4
2015/0309563 A1 * 10/2015 Connor ..... G06F 3/011 73/865.4
2016/0290878 A1 * 10/2016 Severinkangas ..... G01L 1/146
2017/0295306 A1 * 10/2017 Mleczko ..... B29C 45/1615

* cited by examiner

FABRIC WITH EMBEDDED INFORMATION BEACON

BACKGROUND

According to the National Center for Missing and Exploited Children, nearly 800,000 children are reported missing each year in the United States, or 2,000 cases per day. Abductions by strangers are reported to account for 115 of those cases each year. While many children are quickly located, the time interval between a report and reunion with the child can be a frightening experience for all involved.

Wearable tracking and locator systems for have been proposed in the past but few have met with widespread acceptance.

In the most simplistic example, a parent can place a locator beacon in the child's clothing itself—such as in a pocket. Since the beacon is not physically joined to the child in any way, it can easily be removed, misplaced, fall out, or otherwise become separated from the child.

Other attempts to solve the problem have involved locator beacons that are insufficiently integrated into clothing and can be easily removed by simply lifting the beacon out of the bag, cutting it away, or tearing it out. Further, prior art sensors that are visible on the exterior (or otherwise known) may alert an abductor to the presence of the beacon.

Other solutions require bulky, unsightly and non-washable hardware that detracts from the appearance and functionality of the clothing article. Such an inelegant design can detract from the overall appearance and visual impact of an article and may be unattractive to consumers.

Prior solutions have often been limited to the single purpose of pinpointing the location of the article. However, other information embedded in a beacon could be valuable to the manufacturer or consumer.

Prior solutions also fail to identify the parent or guardian of a lost child. In the case of an especially young child, the child may not know a parent's phone number, their address, or other identifying information.

While of perhaps lower concern to an individual, lost personal items—such as clothing, luggage, and accessories—are a continuous problem in everyday life, with the consequences ranging from modest inconvenience to significant economic loss. A misplaced or stolen handbag, for example, can result in a loss of several hundred dollars (a consumer-grade Coach bag, for example) up to nearly $100,000 in the "super-luxury" category that includes certain animal skin bags from Hermes, Bottega Veneta, and others. Compounding the loss of the bag itself may be the loss of its contents, which may include cash, electronics, and even personal items that may be irreplaceable.

Oftentimes a loss is outside the control of the user. For example, even though the rate of bags lost by airlines has been decreasing, industry baggage handlers misplaced an estimated 21.8 million bags in 2013. While more than 80% of these lost bags were ultimately simple delays in transit, over 4 million bags experienced severe delays or were never located. In addition to economic loss, these millions of passengers were inconvenienced, perhaps far from home. Further, people frequently entrust their belongings to coat check agents, hotel bellmen, porters, doormen, and others, with the result sometimes being an article that has been misplaced, stolen, or given to the wrong person.

Lost articles are not the only concern. The authenticity of goods, particularly high-end brands, is important to consumers and designers alike. The quantity and value of counterfeit goods has grown significantly in recent years and by some estimates exceeds $200B each year. According to U.S. Customs and Border Protection, handbags and wallets were the top category for counterfeiters in terms of dollar value, according 2013 statistics. That year, CBP seized 2,200 shipments in this category alone with an MSRP value of $700M, accounting for 40% of the value of all goods seized across all categories. Clothing and apparel was the number four category in 2013 with over $116M in counterfeit goods, representing 7% of the total. The European Union has a similar problem with an estimated €26B in counterfeit clothing and accessories entering the market each year, according to the Office for Harmonization in the Internal Market.

Customs agents and manufacturers have limited means available to combat counterfeiting, including visual inspections, examination at ports of entry, educational campaigns, and the like. Despite greater attention to the problem, the economic impact remains severe.

Proposed solutions for tracking lost articles suffer many of the same drawbacks as those identified with systems for tracking lost children, namely integration into existing materials, conspicuousness, and reliability under varied environmental conditions.

What is thus needed is a means for integrating a washable device into an article of clothing or accessory where the integration is semi-permanent and resistant to tampering, removal, or even detection by a would-be thief.

What is further needed is a means for providing an embedded device that identifies its location, and which can be integrated into an article of clothing or accessory, and which is not impacted by washing the article.

What is further needed is an embedded device that provides identifying information, such as parental contact information, or in the case of a lost article, ownership information or confirmation of authenticity.

BRIEF DESCRIPTION OF THE DRAWINGS

The features and advantages of the present disclosure will be more fully understood with reference to the following detailed description when taken in conjunction with the accompanying figures, wherein.

SUMMARY

In some embodiments, a composite fabric structure may include a first layer formed from a first fabric material, a second layer formed from a second fabric material, and/or an information beacon disposed between the first layer and the second layer. In some embodiments, the first layer is joined to the second layer such is semi-permanently embedded therebetween. In some embodiments, the first layer and the second layer are joined with an adhesive. In some embodiments, the adhesive substantially encapsulates the information beacon to form a protective shell. In some embodiments, the first layer and the second layer are joined with stitching. In some embodiments, the stitching forms a pocket in which the information beacon is disposed. In some embodiments, the first fabric material is leather and the second fabric material is a knit fabric. In some embodiments, the information beacon is a Bluetooth Low Energy device that is configured to communicate with a mobile computing device.

In embodiments, a fashion accessory formed from a composite fabric structure may include a first layer formed from a first fabric material, a second layer formed from a second fabric material, and/or an information beacon disposed between the first layer and second second layer. In some embodiments, the first layer is joined to the second layer such that the information beacon is semi-permanently embedded therebetween. In some embodiments, the fashion accessory is a handbag, a suitcase, a wallet, a briefcase, a shoe, or similar.

In some embodiments, a method of locating a fashion accessory may include associating an information beacon embedded in a composite fabric structure with software running on a mobile computing device, using the software to wirelessly communicate with the information beacon and calculate the relative location of the information beacon, and/or displaying the relative position of the information beacon on the display of the mobile computing device. In some embodiments, the mobile computing device directs the information beacon to generate a notification.

DETAILED DESCRIPTION

A novel fabric system with washable information beacon is disclosed in which an information beacon may be permanently installed, which is not impaired by washing, regular wear by a child, travel, and other environmental factors.

Figure 1:
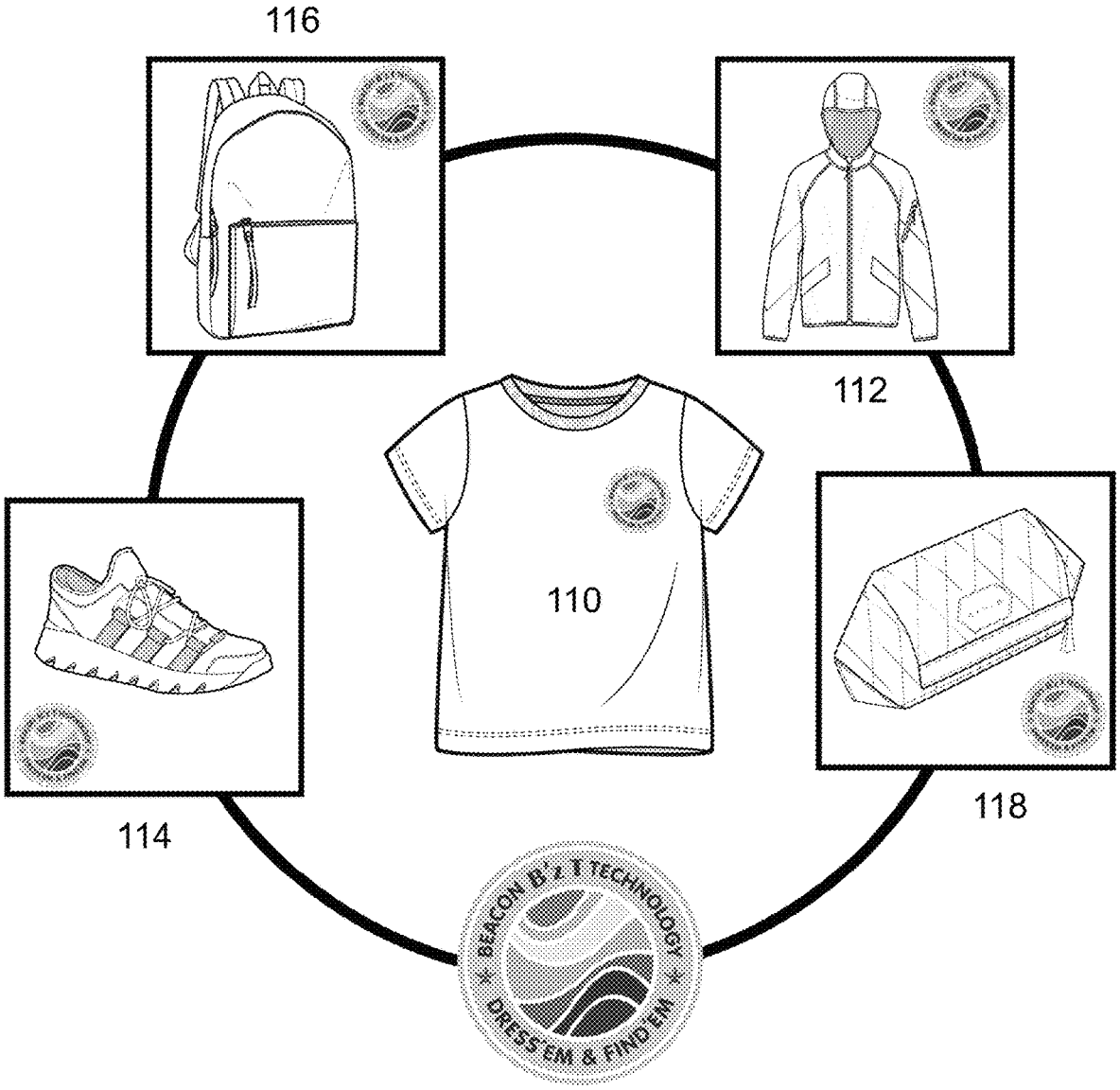
FIG. 1 shows an overview possible usage scenarios for embodiments of the invention.

FIG. 1 shows an overview of an exemplary system in which information beacons may be integrated into a variety of products to provide enhanced location and security functionality. In a preferred embodiment, an information beacon may be incorporated into the fabric of a garment such as a T-shirt 110, as well as other personal garments such as pants, jeans, tops, sweaters, shirts, dresses, and the like. Alternatively, an information beacon may be utilized with an overcoat 112 or other outer garment. Embodiments of the system may similarly be used with footwear 114, bags and luggage 116, and luxury goods 118. These examples illustrate a few of the various applications of the system of the present invention, whether by incorporation into the fabric comprising the article, or the layering of the article itself.

Figure 2:
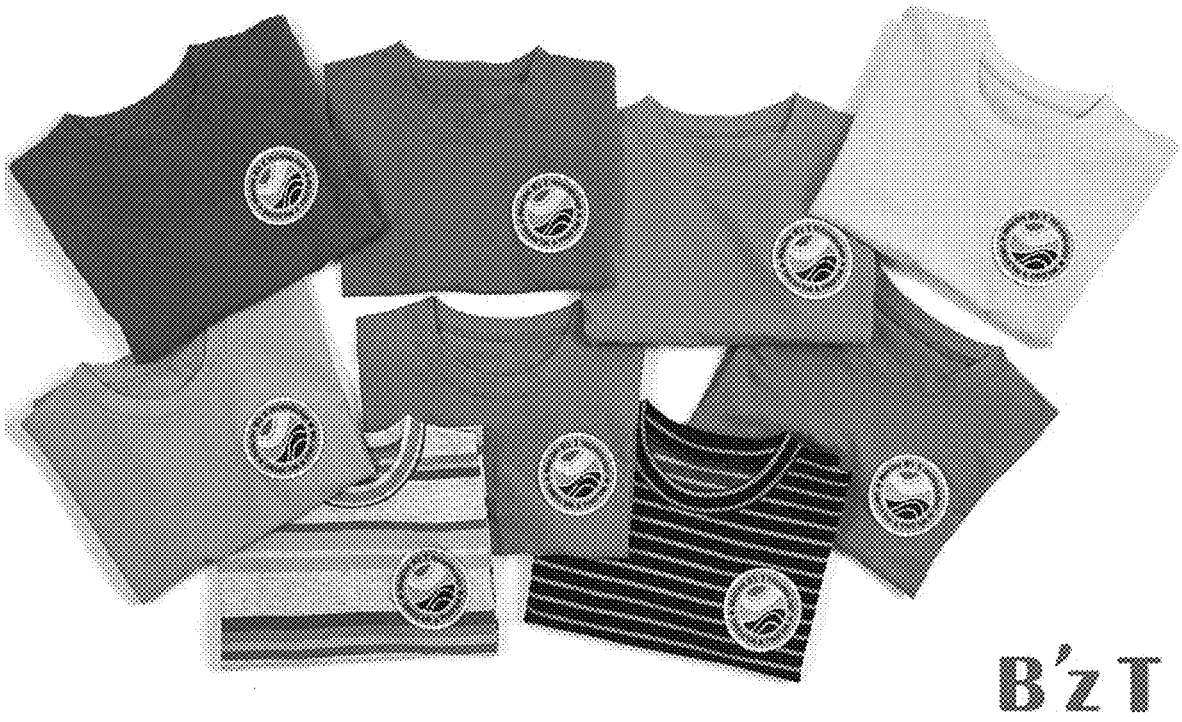
FIG. 2 shows collection of exemplary garments incorporating an embodiment of the invention.

FIG. 2 shows collection of exemplary garments incorporating an embodiment of the invention. A tee-shirt is affixed with a decal Y that incorporates a locator beacon. In this embodiment, a range of materials for tee-shirt are contemplated including cotton (whether organic, pima, Supima, Egyptian, combed, blended, or otherwise), wool, synthetic fabrics (e.g., polyester and rayon, natural fibers, or blends of any of the foregoing, whether with an elastomeric fiber or without.

Figure 3:
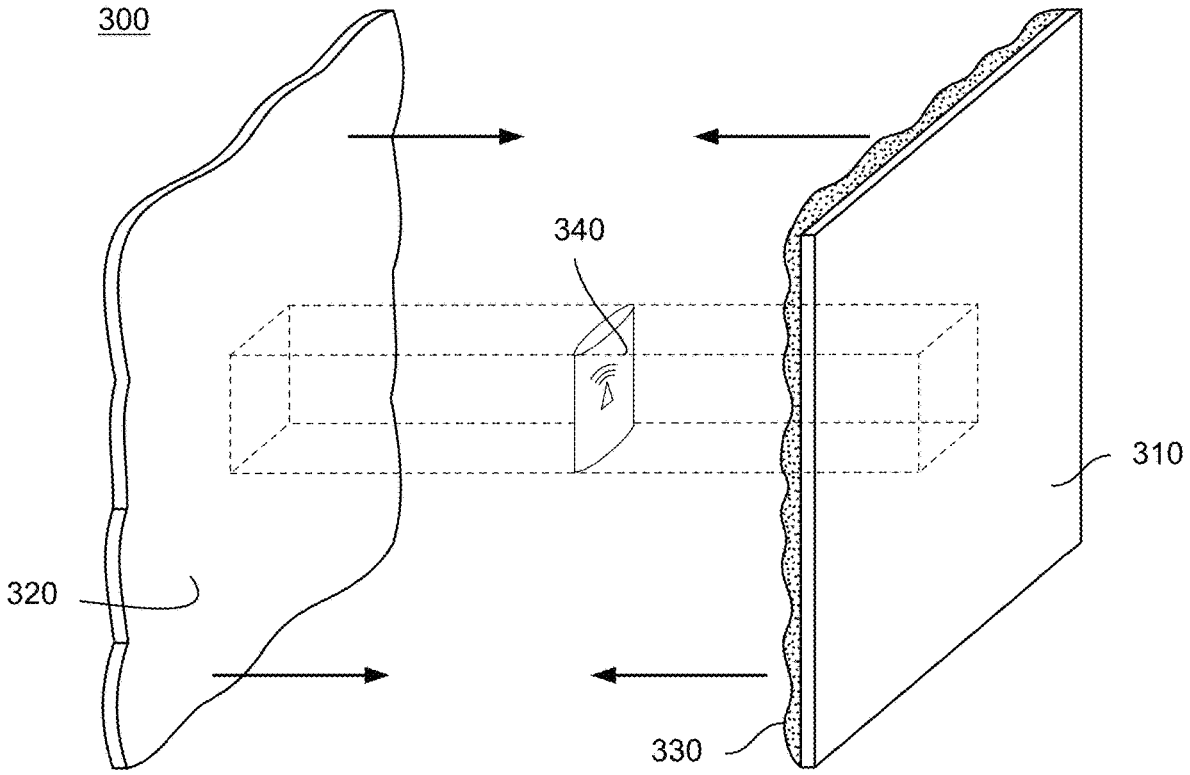
FIG. 3 shows a side view of a composite fabric structure according to embodiments of the invention in which the layers have been joined by adhesive.

Turning to FIG. 3, a composite fabric structure 300 is shown with a first layer 310, second layer 320, and an adhesive 330 between the layers. An information beacon 340 is shown disposed between layers 310 and 320.

Figure 4:
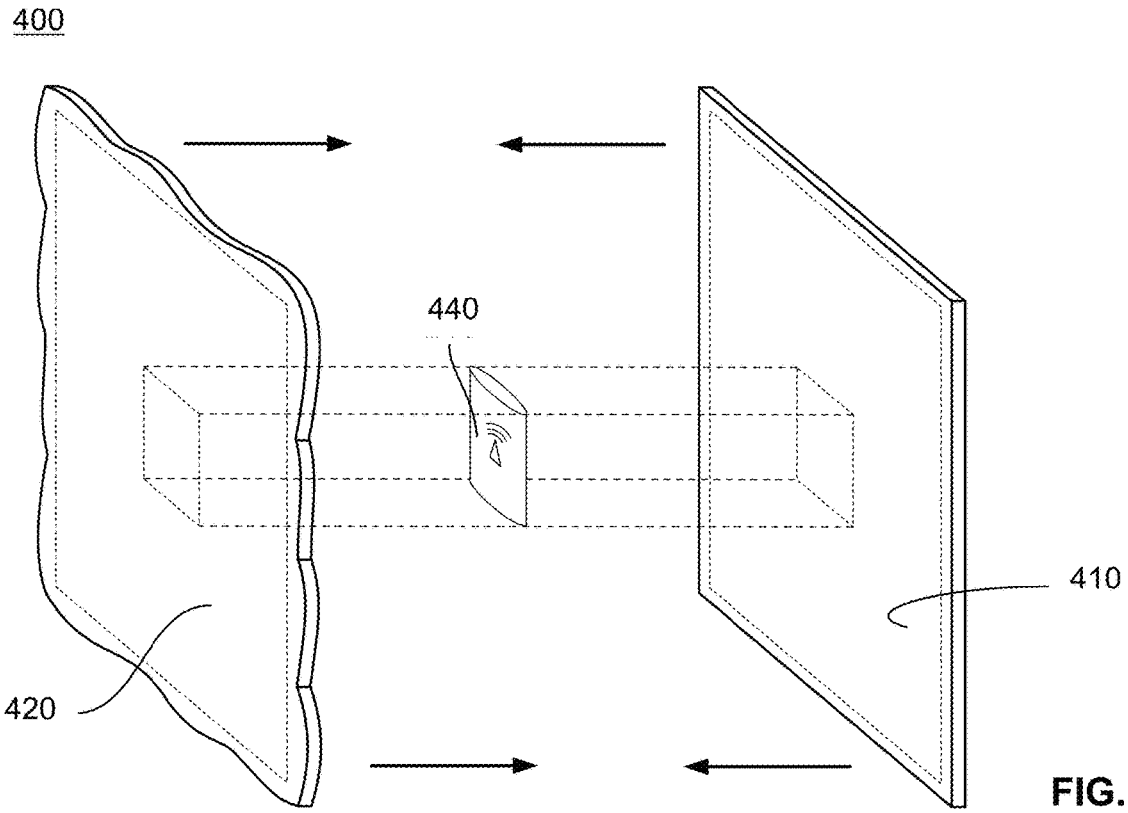
FIG. 4 shows a side view of a composite fabric structure according to embodiments of the invention in which the layers have been joined by stitching.
Figure 5A:
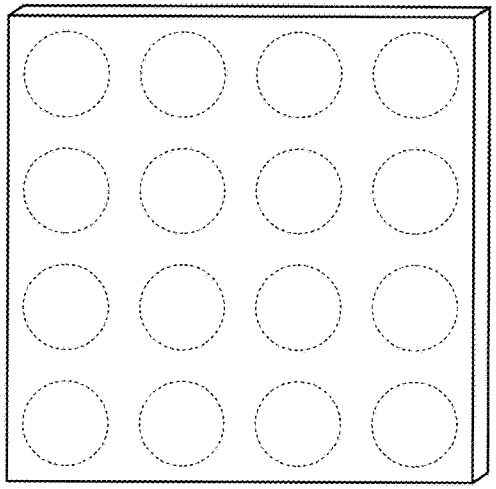
FIGS. 5(*a*)-(*f*) show a selection of exemplary quilted stitch patterns that may be employed with the present invention.
Figure 5B:
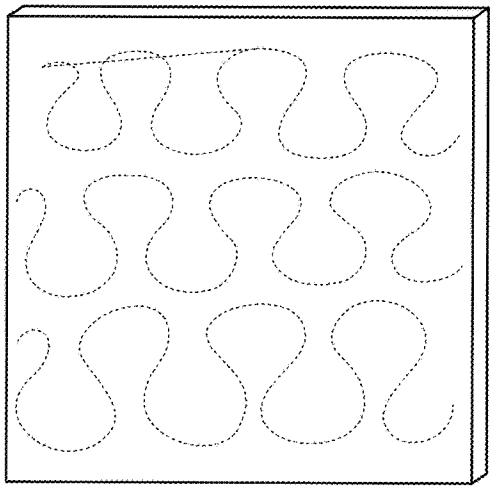
Figure 5C:
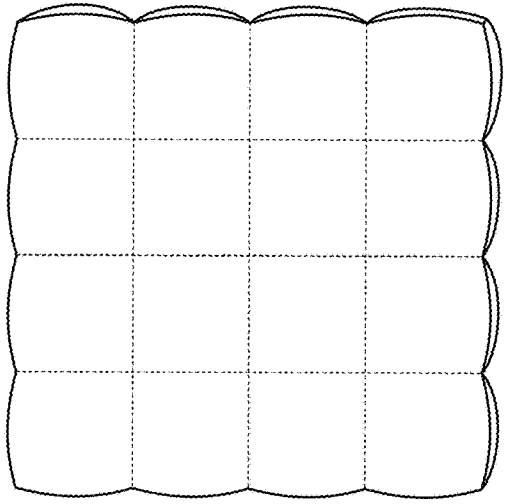
Figure 5D:
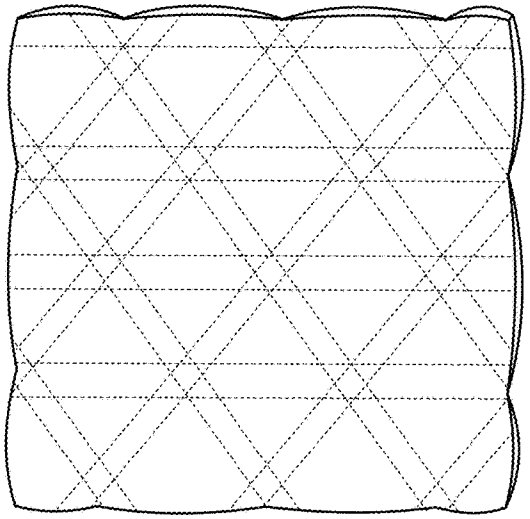
Figure 5E:
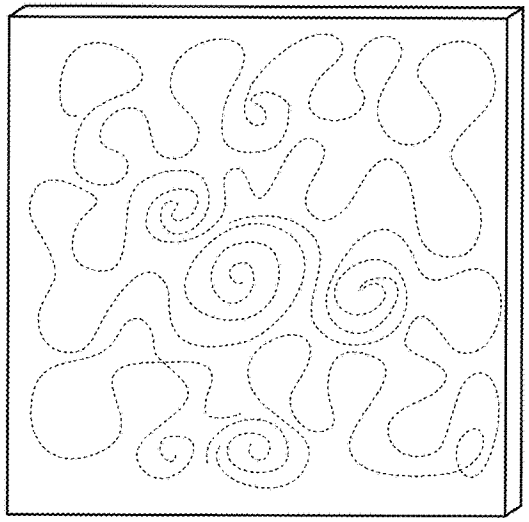
Figure 5F:
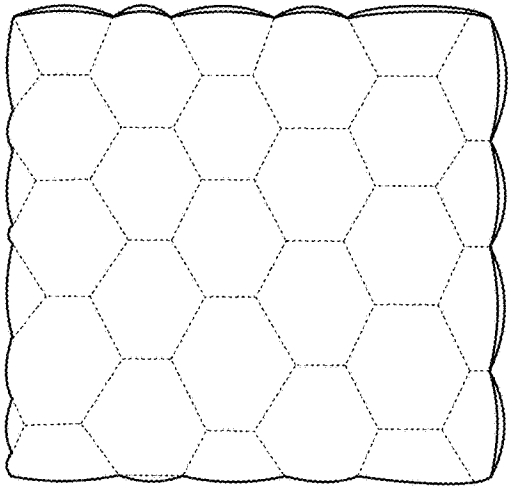

FIG. 4 shows a composite fabric structure 400 in which a first layer 410 and second layer 420 have been joined by stitching. An information beacon 440 is shown disposed between layers 410 and 420.

FIGS. 3 and 4 each show an exploded view in which the layers have been separated for explanatory purposes. The arrows indicated the direction that the opposing layers would take during manufacture to form a complete and integrated product.

The individual layers of material used in the various layers of the composite may be selected to match the intended use of the material. For example, a handbag embodiment may have an external surface visible to the outside world that requires a sleek and elegant appearance, while the internal surface may be driven less by aesthetics, and more by functional concerns such as wear or soil resistance. An embodiment used to fabricate an overcoat may have an external surface visible to others that is formed from a material that is durable and weather-resistant, while the internal surface adjacent the wearer's body during may require a softer material, or a material that is more conducive to embedding an information beacon.

In embodiments, a material may be chosen for its thickness, pile, softness, texture, or other characteristics, to further mask the presence of an embedded information beacon.

Several example fabric combinations are disclosed below in connection with various usages. These examples are meant only to provide illustrations of how the novel composite material can be formed.

Referring to FIG. 3, first layer 310 may comprise a durable material that is resistant to environmental factors, and also attractive. Numerous varieties of material are contemplated as coming within the scope of the invention and include, for example, animal hides such as cow skin, calfskin, lambskin, snakeskin, crocodile skin, as well as synthetic leathers such as "vegan" leathers, pleather, leatherette, and faux leather. Various non-leather materials may be used for first layer 310 including, without limitation, materials based on fibers such as cotton, hemp, linen, nylon, polyester, and the like.

A second layer 320 may be any material that is capable of being joined to the first layer 110 using the selected joining means. For example, cotton twill will readily bond to leather using an adhesive. In contrast, a thin material such as organza may be difficult to bond to leather because of its physical characteristics. Similarly, canvas may readily bond to leather with rivets, adhesive, or stitching, while lace may be less desirable because it may be difficult to hide the information beacon.

In embodiments, an information beacon may be hidden behind a garment feature such as the logo or emblem shown in FIG. 2, with the logo or emblem and fabric forming a pocket similar to FIG. 3.

The specific combination of fabric used will depend on the type of article to be sewn from the composite material and the type of information beacon embedded therein. Specific combinations that have been found to work are disclosed in the "Examples" section below.

In embodiments, a lining may be integrated adjacent the second layer.

In embodiments, second material 320 may comprise any material that is capable of being joined to the first layer 310, and would include at least any of the materials described above for first layer 310.

In addition to the type of fabric used, consideration may be given to the structure of full-fashion knit used in the composite. It has been found that various sweater knit structures are suitable for bonding consistent with the teachings of the present invention. For example, 3 gauge 2×2 basket stitch knit has been used with success. Various gauges of sweater knit or other material may be used such as 1.5 Gauge, 3 Gauge, 7 Gauge, 9 Gauge, 12 Gauge, and 14 Gauge. Similarly, various textures may be utilized for the sweater knit such as jersey, rib, seed, basket, cable and any possible stitch by both machine and hand.

In the case of leather bonded to a cut-and-sewn knit, a variety of knits are contemplated as part of the invention such as Jacquard, pique, Ponte, and scuba. For leather bonded to a woven fabric, materials may be used such as twill, denim, canvas, tweed, chino, gabardine, and corduroy.

In embodiments of the invention, the composite layers are bonded together by a means that will provide a bond that is permanent or semi-permanent. In embodiments, the bond may also provide aesthetic enhancement to the layers.

Referring to FIG. 3, an adhesive 330 may be applied during manufacturing to semi-permanently join the layers together. In embodiments, adhesive 330 may be a polyurethane adhesive, which has been shown to have good binding power for soft materials such as fabric, and which creates foam that seeps into small fabric gaps and forges a stronger bond when exposed to moisture, enhancing the durability of the bond during use.

Other adhesives may be used with the present invention provided that they are resistant to environmental conditions, and are durable.

Referring to FIG. 4, layers 410 and 420 are joined together by stitching. A variety of stitching patterns have been shown to work with the present invention, including a running stitch, hemming stitch, basting stitch, catch stitch, backstitch, overcast stitch, and invisible stitch, among others. Patterns may also be introduced using stitching such as geometric patterns, free patterns, grid quilted patterns, circular patterns, and the like. The particular stitching and pattern will be driven by the type of fabric used, as well as the size and type of information beacon hidden therein.

Figure 6:
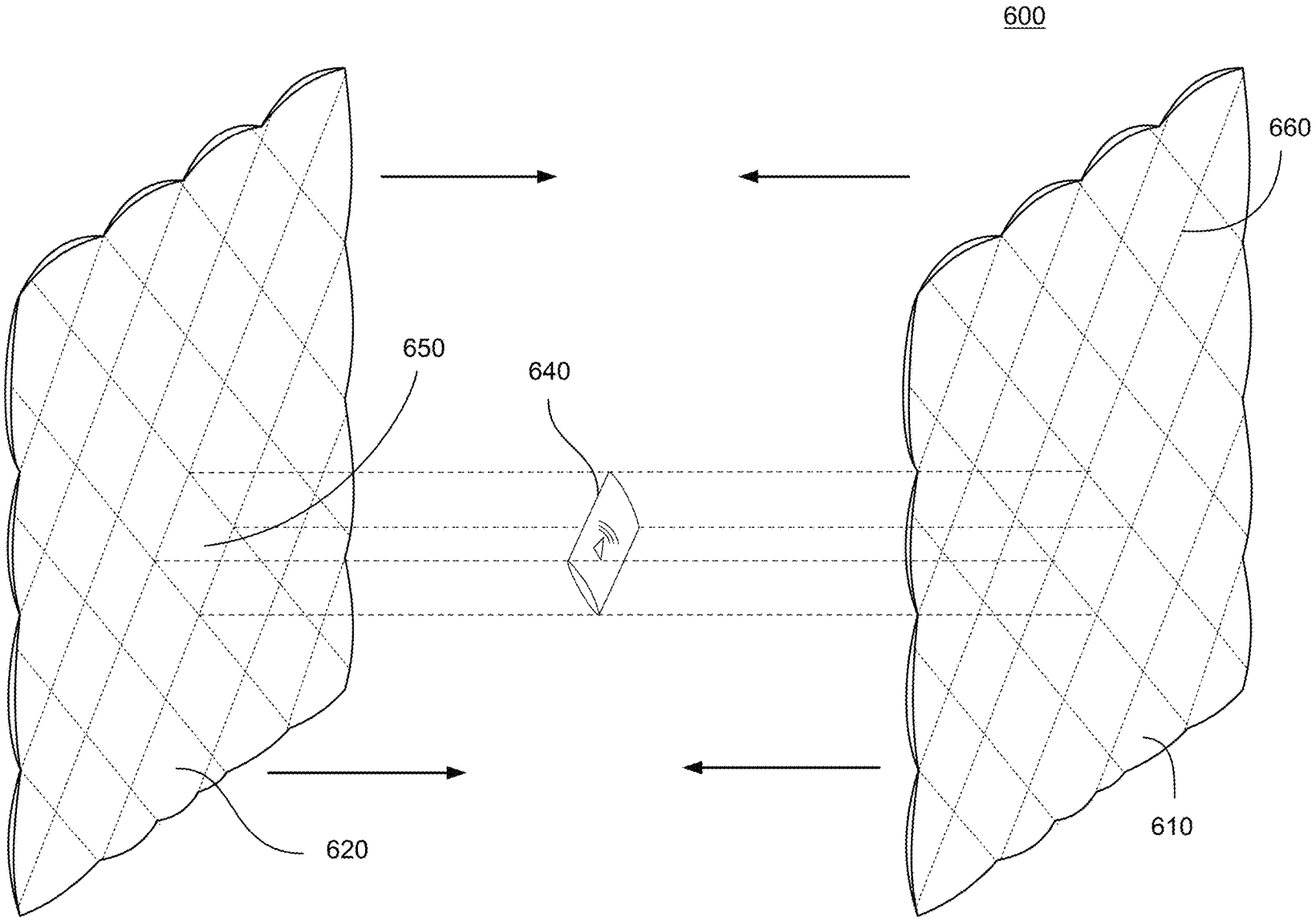
FIG. 6 shows a composite fabric in which the layers have been joined using a stitching pattern that defines a quilted pattern.

In embodiments, the joining means can be utilized to impart a decorative pattern onto the surface(s) of the composite. Referring to FIG. 5, a variety of exemplary quilting patterns are shown that may be stitched onto the article. A quilted pattern is formed from quilt-stitching the two layers of the composite material in a decorative or utilitarian shape. Referring to FIG. 6, the application of quilting to the present invention is shown. A composite fabric structure 600 is shown with a first layer 610, second layer 620, and an information beacon 640 between the layers. Quilted stitching may be used to join layers 610 and 620 in any decorative or utilitarian pattern. In exemplary embodiments, the quilting pattern is stitched such that one or more pockets are formed between the layers and are of sufficient size to accommodate information beacon 640.

Alternative joining means are contemplated as coming within the scope of the invention. For example, rivets may be used to join the first and second layers to provide both function and a decorative appearance. In the same manner that stitching may leave un-joined regions between the layers, rivets that have been spaced apart may similar define pockets into which an information beacon may be positioned.

It will be appreciated by those of ordinary skill in the art that the novel composite fabric disclosed herein may come in a variety of shapes and sizes, including individual swatches, pre-cut segments, and rolls, among others.

Figure 7:
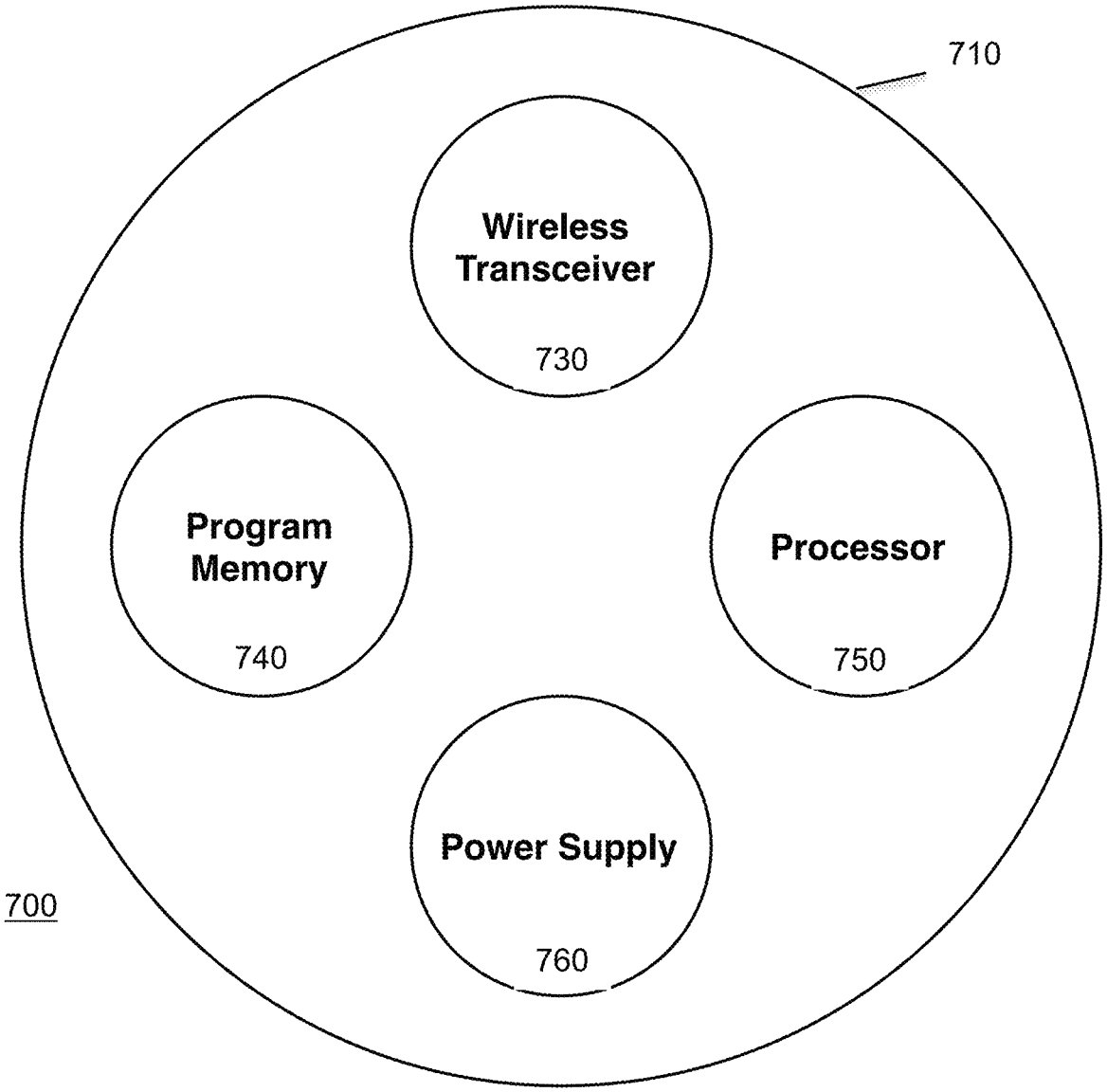
FIG. 7 shows a functional diagram of an information beacon according to embodiments of the invention.

Referring to FIG. 7, a functional diagram of an exemplary information beacon is shown. An exemplary chip may contain a water-resistant housing 710 that contains the system components. Components of an exemplary information beacon may include a SoC ("system-on-a-chip") with an integrated Bluetooth Smart (also known as Bluetooth Low Energy) transceiver 730, memory 740, central processing unit 750, and power supply 760. The nRF52832 or nRF51822 from Nordic Semiconductor are examples. In embodiments, the system components inside the housing will have a small form factor. For example, the nRF52832 measures 3.0×3.2 mm in a quad flat no-leads package, and is powered by a CR2016 battery.

In embodiments, an information beacon may be housed in a protective shell that protects the electronic or other components from extreme temperatures (such as during a bonding process using hot melt adhesive), pressure, impact, and other forces that could impair the functioning of the information beacon. An exemplary beacon housed in a protective shell is shown in FIG. 8.

A protective shell formed around an information beacon should not, preferably, significantly impair the transmission of electromagnetic waves between the beacon and an external reader. Suitable protective shells may include epoxy, polymers, foams, and the like.

In a preferred embodiment, a two-part pressure molding process may be utilized to encapsulate the information beacon. In embodiments involving garments that are subjected to immersion in water, such as washable garments, swimwear, and the like, water may seep into electronic components causing malfunction or a failure. Where a garment is put through a washing and drying cycle, swings in temperature may result in condensation within the beacon.

In addition to moisture, high (and low) temperatures risk impairing the device. For example, a drying cycle in a home clothes dryer can reach 130° F. or higher, while commercial clothes dryers may reach 145° F. or higher, beyond the threshold for causing thermal damage to the components of the beacon. Ironing and teaming the garment may introduce even higher temperatures, and additional moisture.

It has been found that low pressure molding allows complete watertight encapsulation and thermal insulation to protect the system electronics during expected care and usage. The Technomelt product by Henkel is one example that has been found to work with the present invention.

A low-pressure molding solution may provide resistance to liquids, high temperature resistance, and superior adhesion between the molding material and system components.

Because the molding process at low pressure, the cycle time is short and fine or fragile circuitry in the beacon is not damaged.

While a low-pressure molding solution is preferred, traditional potting or encapsulating processes are contemplated as coming within the scope of the invention, and may be appropriate where conditions are less demanding or cost is a factor.

In embodiments, a shell may be formed around the information beacon during a bonding process and may utilize the bonding agent to form protective shell. For example, a bond using adhesive may encapsulate the information beacon with the adhesive used to join the layers of the composite fabric. In this manner, the beacon is both semi-permanently bonded to the composite fabric, and protected from environmental factors.

In further embodiments, a composite fabric is provided having two or more layers that are adhered or stitched together, or otherwise joined, and in which an information beacon has been embedded. The information beacon may be treated with a molding agent prior to embedding.

In embodiments, an information beacon should have a power source that is long-lasting under normal anticipated operating conditions. The choice of batter may factor in the desired physical characteristics of the beacon since higher-capacity battery cells are generally thicker and heavier than cells with lower capacities. A thinner battery may thus provide a shorter life but present a sleeker form factor. A thicker battery may have a longer life, but may be unsuitable for applications requiring a thin, light beacon. Prototype embodiments of the invention utilized a CR1632 coin cell battery, which at under two grams in weight and measuring roughly 16 mm×3 mm (diameter×thickness), was found to be a suitable balance of life, weight, and size. It should be noted that a variety of sizes of power cells are contemplated as coming within the scope of the invention, being limited only by the application. Alternative power supplies are contemplated such as rechargeable batteries, or charging by induction.

To extend the service life of the beacon, embodiments of the invention may include an activator mechanism to power on the device. A long lead time between manufacturing and the consumer—which can include multi-stage intercontinental shipping and incorporation into a finished product—may reduce the service life of the beacon. To mitigate the power loss in the device prior to reaching the consumer, a beacon may be manufactured and sealed with the power disconnected, to be activated by the consumer. However, where a beacon is encapsulated in a shell, the consumer may not, by design, have access to the components of the beacon, which are encased in a protective shell impervious to environmental factors.

Figure 8A:
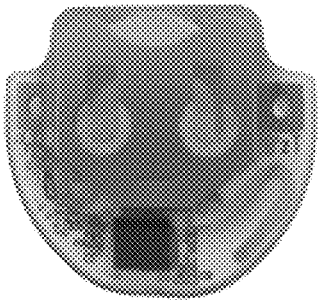
FIGS. 8*a*-8*b* shows the top and bottom sides of an exemplary information beacon after application of an outer shell.
Figure 8B:
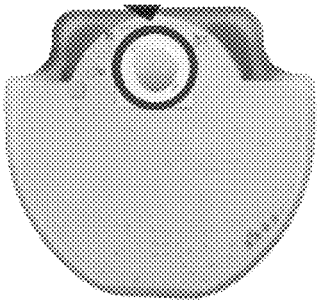

In embodiments, an activator button may be incorporated into the beacon to activate the power cell without penetrating the protective shell. Referring to FIGS. 8*a*-8*b*, the top and bottom sides of a beacon comprising an activator button is shown. A hollow recess may be formed beneath the outer shell so that when a force is applied to the button region of the beacon, the shell deforms and comes into contact with the activator button, starting the device.

In addition to specialized or custom information beacons, off-the-shelf components may be employed. For example, locator beacons manufactured by Tile, Pixie, and Yunzi have been shown to work with the present invention. In a preferred embodiment, a custom beacon may be developed with a form factor that complements the intended usage.

In embodiments, radio frequency identification (RFID) may be utilized and an alternative to Bluetooth. As will be appreciated by those of skill in the art, certain types of RFID may perform better than others with the system of the present invention. For example, RFID operating in the ultra-high frequency range (UHF) offer an extended range as compared to the low- and high-frequency ranges. In embodiments, near-field communications technology may be employed. The present invention is not limited to any particular wireless technology.

In embodiments, an information beacon may be activated using a Bluetooth-equipped device such as a smartphone, tablet, or personal computer. In embodiments, a Bluetooth-equipped device may utilize software to show the user where the information beacon (and thus the fabric or article incorporating the fabric) is located. In further embodiments, the location may be presented on a map on the Bluetooth-equipped device.

In embodiments, information beacon may be configured to generate a notification when activated, such as an alarm sound or vibration.

In embodiments, an information beacon is inserted in the composite fabric during manufacturing of the fabric. In embodiments, the composite fabric of the present invention may be manufactured or delivered in uncut segments, with information beacons dispersed throughout, that are later cut for manufacturing specific items.

Figure 9A:
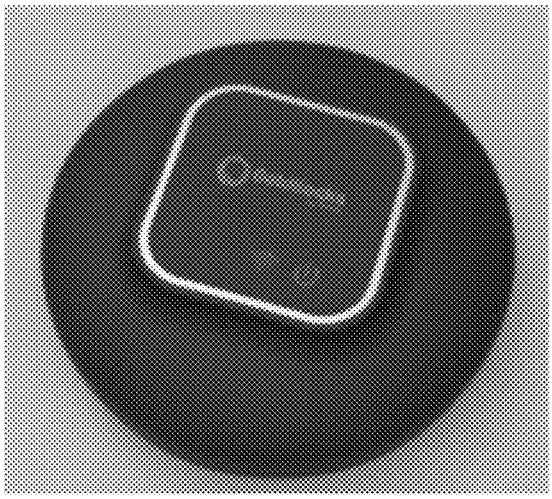
FIGS. 9*a-b* shows show exemplary communication gateways for use with embodiments of the present invention.
Figure 9B:
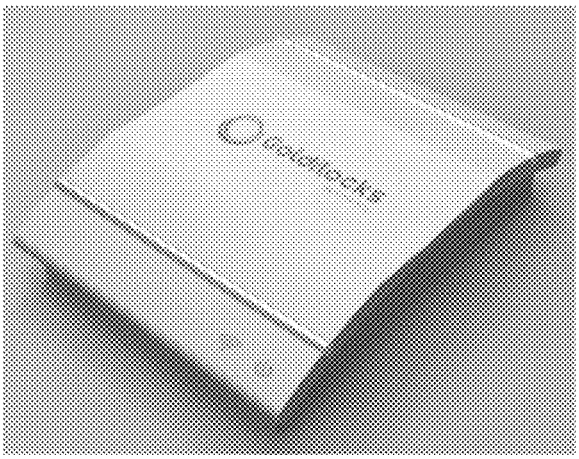
Figure 10:
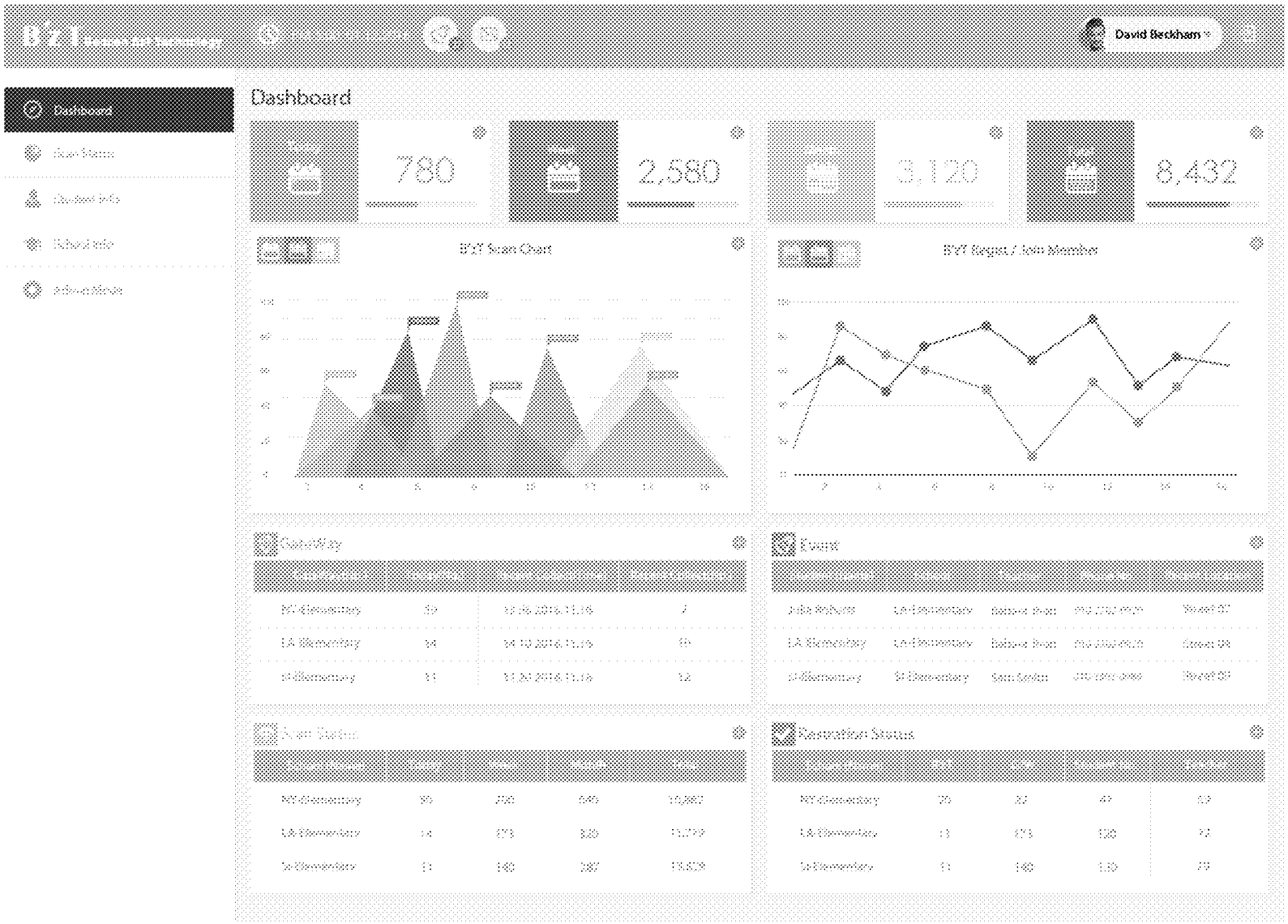
FIG. 10 shows an exemplary user interface for use with embodiments of the present invention.

A system may be provided for tracking and communicating with the articles and beacons described herein. A variety of communication means are contemplated, included pairing with mobile phones and mobile computing devices, communication gateway bridges, cellular data connection, and the like. In embodiments, a gateway bridge may scan a child's information beacon when in range and provide that information to the parent. Such a system may provide not only specific location information, but tracking information as a child (or children) passes a waypoint (e.g., school bus door, school cafeteria, etc.). Exemplary gateway bridges are shown in FIGS. 9*a*-9*b*. A communication gateway bridge may be a relay that provides a secure connection Visualization, data, and location may be provided through mobile devices or a web portal. An exemplary web portal is shown in FIG. 10.

Figure 11:
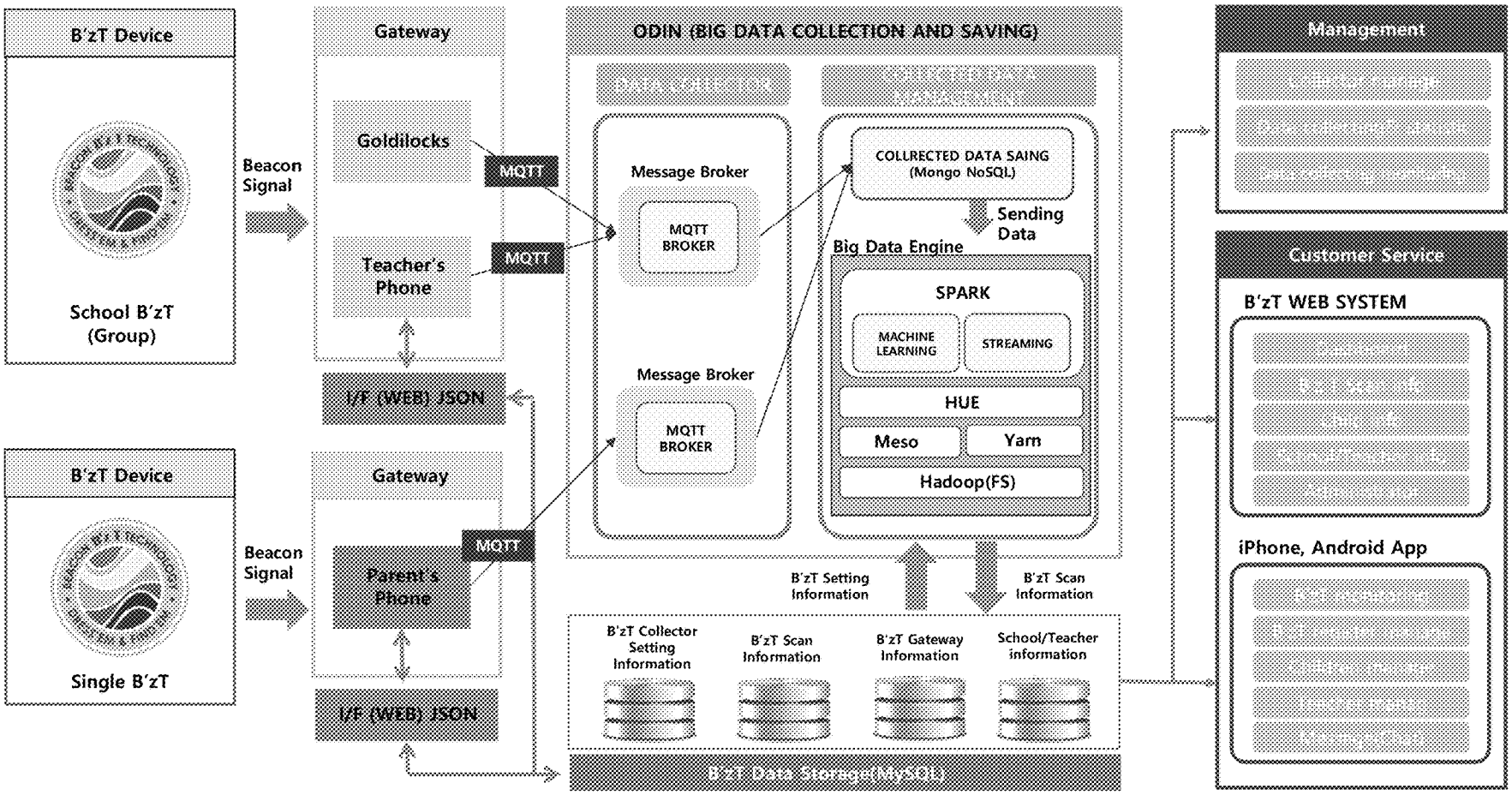
FIG. 11 shows a schematic of an exemplary system incorporating communication gateways, data processing and storage, and user interface elements.

A schematic of an exemplary system incorporating locator beacons, communication gateways, data processing and storage, and user interfaces is shown in FIG. 11.

Embodiments of the invention may be better understood with reference to the following example implementations:

Example 1: T-Shirt

A child's tee-shirt was fabricated from an organic cotton material. An information beacon was embedded in a three-dimensional animal design incorporated onto the surface of the garment. The information beacon was paired with a smartphone for providing a visual display of the location of the child.

Example 2: Child's Shoe

Referring to FIG. 8, an exemplary usage is shown in the form of a child's shoe 800. In a shoe embodiment, outer layers are formed from cow skin leather having a thickness of 1.2 mm and which has been joined to a cotton canvas lining using a self-crosslinking-type water-based polyurethane fabric adhesive. An information beacon has been embedded between the layers during manufacturing.

Example 3: Winter Coat

A winter coat was fabricated from the materials of the present invention. A mink skin was bonded to scuba (300 g/m2 96% polyester 4% spandex) using a self-crosslinking type water-based polyurethane fabric adhesive. An information beacon was embedded between the layers during manufacturing.

Example 4: Hiker's Backpack

A hiker's backpack was fabricated from the materials of the present invention. In this example, 70 D (Denier) 100% nylon standard X-Pac™ was bonded to 50 D (Denier) 100% polyester taffeta using a self-crosslinking type water-based polyurethane fabric adhesive. An information beacon was embedded between the layers during manufacturing.

Example 5: Wallet

A wallet was fabricated from the materials of the present invention. In this example, crocodile skin was bonded to pig skin with 3M spray glue 77. An information beacon was embedded between the layers during manufacturing.

Example 6: Handbag

Figure 12:
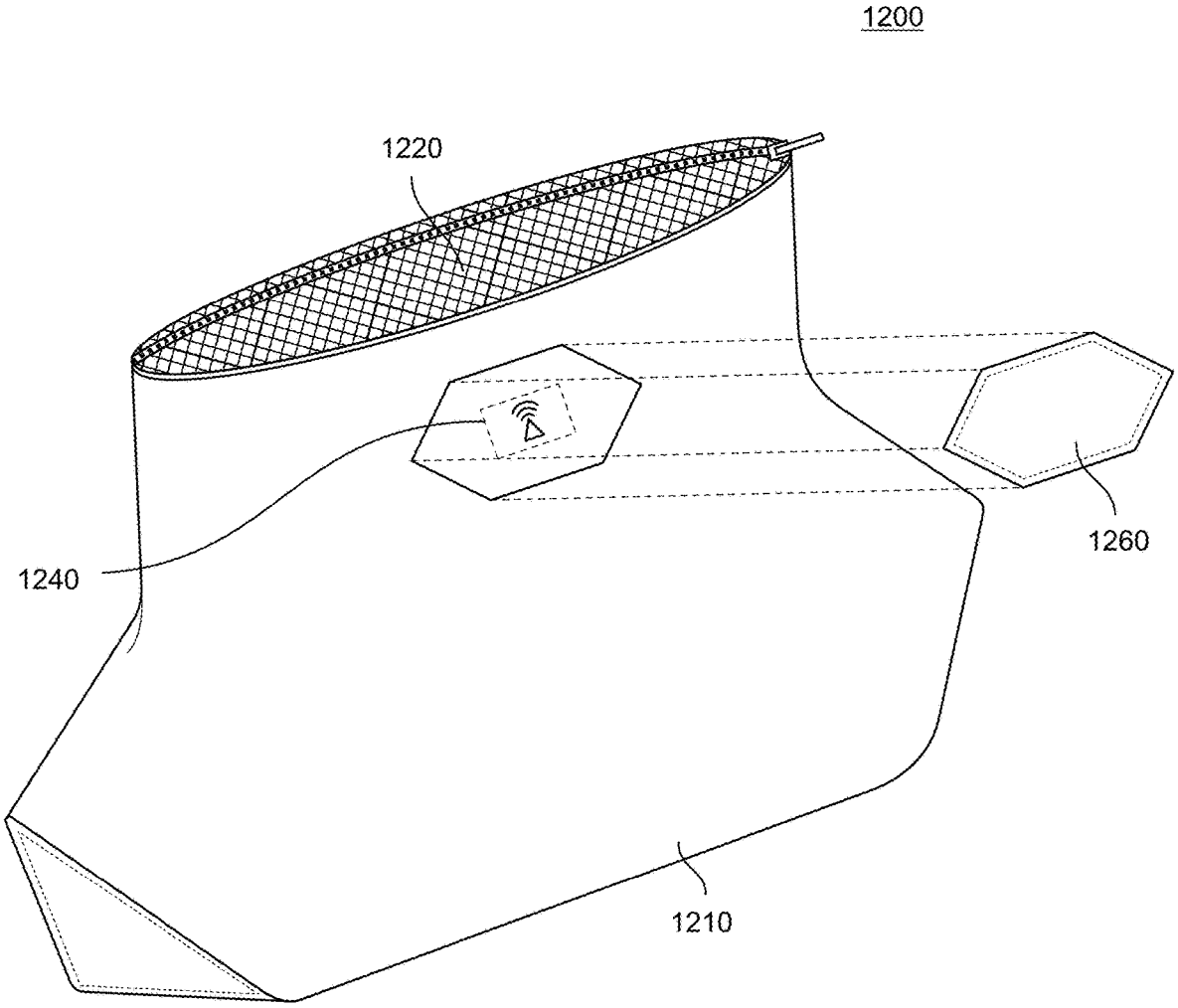
FIG. 12 shows an exemplary handbag formed from the composite material of embodiments of the present invention.
Figure 13:
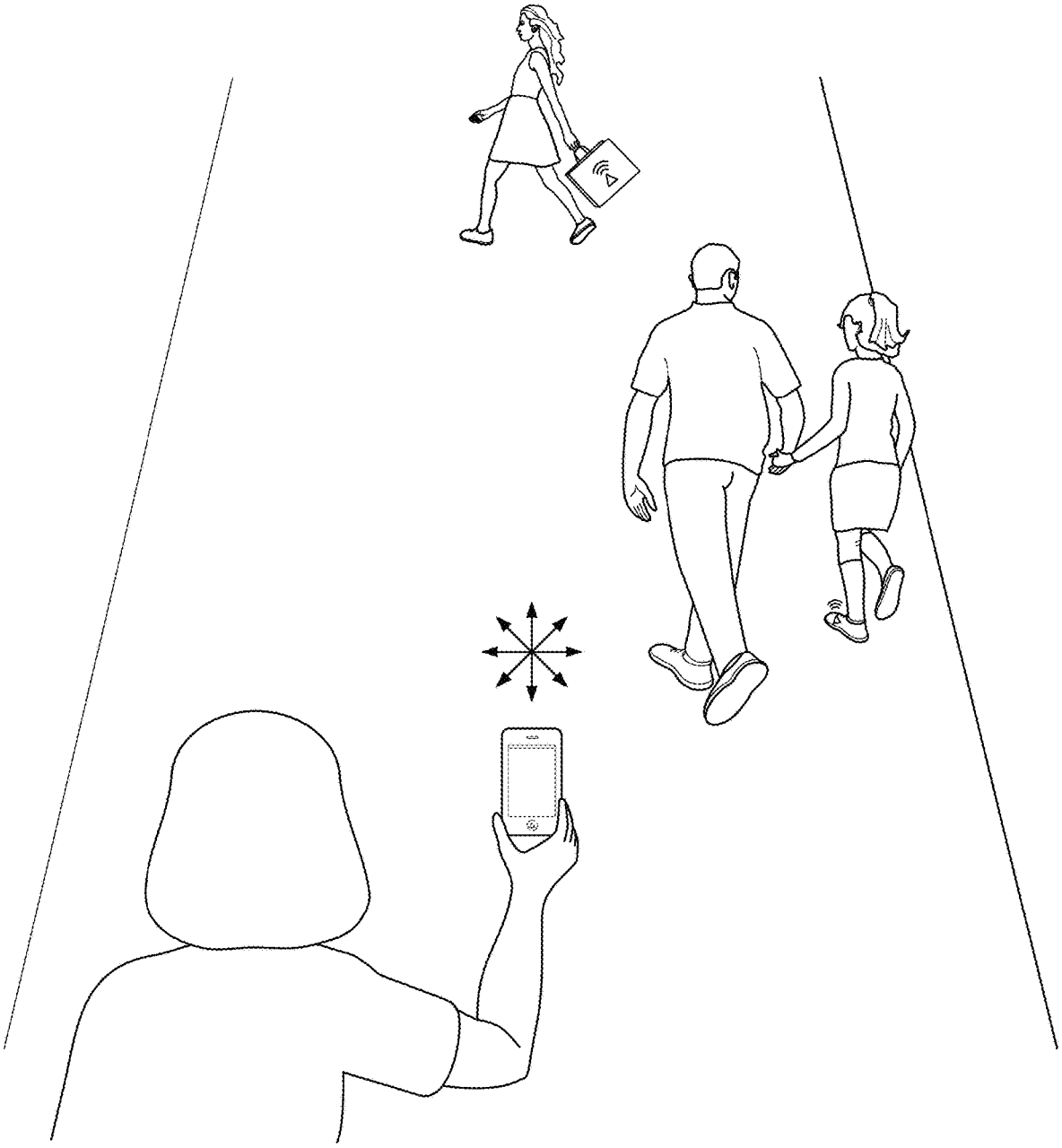
FIG. 13 shows an exemplary usage scenario for embodiments of the present invention.

Referring to FIG. 12, an exemplary embodiment is shown in the form of a woman's clutch purse 1200. Outer layer 1210 is formed from lambskin leather having a thickness of 1.0 mm that has been joined to a sweater knit lining 1220 using a self-crosslinking-type water-based polyurethane fabric adhesive. An information beacon 1240 has been embedded between the layers during manufacturing, and is further obscured by the presence of the designer's label 1260 on the exterior.

Example 7: School Bus

A school bus was outfitted with a communication gateway in encrypted and secure wireless communication with a remote server. Student uniforms were each embedded with an information beacon that was paired with the communication gateway to record the comings and goings of students on the bus, and to provide that information to the remote server where it was accessible by parents and school administrators.

It will be understood that there are numerous modifications of the illustrated embodiments described above which will be readily apparent to one skilled in the art, including any combinations of features disclosed herein that are individually disclosed or claimed herein, explicitly including additional combinations of such features. These modifications and/or combinations fall within the art to which this invention relates and are intended to be within the scope of the claims, which follow. It is noted, as is conventional, the use of a singular element in a claim is intended to cover one or more of such an element.

I claim:

1. A wearable locator system comprising:

a washable information beacon, the washable information beacon including a microprocessor, a power supply, an activator button, a wireless transceiver, and a memory, the microprocessor, the power supply, the activator button, the wireless transceiver, and the memory being housed in a protective shell that allows for complete watertight encapsulation and thermal insulation thereby protecting the microprocessor, the power supply, the wireless transceiver, and the memory during wear, washing, high-heat drying and high-heat ironing without impairing a transmission of electromagnetic waves between the washable information beacon and an external reader, the protective shell being formed from a low pressure molding process; and a fabric material having the washable information beacon semi-permanently affixed thereto, wherein a button region of the protective shell is configured to have contact with the activator button so that deformation of the button region of the protective shell applies a force to the activator button without penetrating the protective shell thereby activating the power supply, the activator button configured to be activated by an end user so as to mitigate power loss between manufacture and end use.

2. The wearable locator system of claim 1 wherein the protective shell further comprises a hollow recess formed beneath the protective shell for housing the activator button.

3. The wearable locator system of claim 1 wherein the fabric material is a composite material formed from a plurality of layers the first layer is joined to the second layer such that the information module is semi-permanently embedded therebetween.

4. The wearable locator system of claim 3 wherein the composite material is formed prior being cut into individual garments.

5. The wearable locator system of claim 3 wherein the composite material is joined with an adhesive.

6. The wearable locator system of claim 3 wherein the composite layer is formed with stitching.

7. The wearable locator system of claim 6 wherein the stitching forms a pocket in which the washable information beacon is disposed.

8. The wearable locator system of claim 1 wherein the protective shell is formed from one of: a polymer, an epoxy, a foam.

9. The wearable locator system of claim 1 wherein the protective shell protects the microprocessor, the power supply, the wireless transceiver, and the memory of the washable information beacon from temperatures of 145 degrees or higher.

10. The wearable locator system of claim 1 further comprising:

a communication gateway, wherein the washable information beacon is paired with the communication gateway to record the coming and goings of the washable information beacon within a specified environment.

11. The wearable locator system of claim 10 further comprising:

a remote server, the remote server configured to receive data related to the coming and goings of the washable information beacon within a specified environment, wherein the remote server is accessible by end users.

12. A method for locating an object comprising:

providing a washable information beacon, the washable information beacon including a microprocessor, power supply, an activator button, wireless transceiver, and memory, the power supply, the activator button, the wireless transceiver, and the memory being housed in a protective shell that allows for complete watertight encapsulation and thermal insulation thereby protecting the microprocessor, the power supply, the activator button, the wireless transceiver, and the memory during wear, washing, high-heat drying and high-heat ironing without impairing a transmission of electromagnetic waves between the washable information beacon and a computing device, the protective shell being formed from a low pressure molding process;

semi-permanently affixing the washable information beacon to an object;

establishing a wireless connection between the washable information beacon and the computing device to calculate the location of the washable information beacon; and transmitting the location of the washable information beacon to a user computing device configured to provide a graphical display of the relative location of the washable information beacon, wherein a button region of the protective shell is configured to have contact with the activator button so that deformation of the button region of the protective shell applies a force to the activator button without penetrating the protective shell thereby activating the power supply, the activator button configured to be activated by an end user so as to mitigate power loss between manufacture and end use.

13. The method for locating an object of claim 12 wherein the protective shell further comprises a hollow recess formed beneath the protective shell for housing the activator button.

14. The method for locating an object of claim 12 wherein the object material is a composite fabric material formed from a plurality of layers the first layer is joined to the second layer such that the information module is semi-permanently embedded therebetween.

15. The method for locating an object of claim 14 wherein the composite material is formed prior being cut into individual garments.

16. The method for locating an object of claim 14 wherein the composite material is joined with an adhesive.

17. The method for locating an object of claim 14 wherein the composite layer is formed with stitching.

18. The method for locating an object of claim 17 wherein the stitching forms a pocket in which the washable information beacon is disposed.

19. The method for locating an object of claim 12 wherein the protective shell is formed from one of: a polymer, an epoxy, a foam.

20. The method for locating an object of claim 12 wherein the protective shell protects the microprocessor, the power supply, the wireless transceiver, and the memory of the washable information beacon from temperatures of 145 degrees or higher.

* * * * *